United States Patent [19]

Behr et al.

[11] Patent Number: 4,766,948

[45] Date of Patent: Aug. 30, 1988

[54] PROCESS FOR CASTING ALUMINUM ALLOYS

[75] Inventors: Friedrich Behr, Essen; Heinrich Ballewski, Neukirchen-Vluyn; Wolfgang Grossmann, Moers, all of Fed. Rep. of Germany

[73] Assignee: Thyssen Industrie AG, Fed. Rep. of Germany

[21] Appl. No.: 109,464

[22] Filed: Oct. 15, 1987

Related U.S. Application Data

[63] Continuation-in-part of Ser. No. 847,428, Apr. 2, 1986, abandoned.

[51] Int. Cl.[4] ..... B22C 3/00

[52] U.S. Cl. ..... 164/516; 106/38.22; 106/38.27; 164/35; 164/72; 164/138; 427/133

[58] Field of Search ..... 164/516–519, 164/35, 72, 138, 55.1, 56.1, 57.1; 106/38.22, 38.27; 427/133

[56] References Cited

U.S. PATENT DOCUMENTS

| | | | |
|---|---|---|---|
| 1,347,481 | 7/1920 | Jeffries | 164/138 |
| 2,435,121 | 1/1948 | Bean | 164/72 |
| 3,157,926 | 11/1964 | Horton et al. | 164/138 X |
| 3,587,713 | 6/1971 | Halsey | 164/138 X |
| 4,557,316 | 12/1985 | Takayanagi et al. | 164/138 X |

FOREIGN PATENT DOCUMENTS

| | | | |
|---|---|---|---|
| 963642 | 5/1957 | Fed. Rep. of Germany . | |
| 1265356 | 4/1968 | Fed. Rep. of Germany . | |
| 1271909 | 7/1968 | Fed. Rep. of Germany . | |
| 1433969 | 2/1973 | Fed. Rep. of Germany . | |
| 54-38231 | 3/1979 | Japan | 164/138 |
| 505087 | 5/1939 | United Kingdom | 164/138 |
| 908482 | 3/1982 | U.S.S.R. | 164/138 |
| 1090483A | 5/1984 | U.S.S.R. | 164/138 |

OTHER PUBLICATIONS

Brunnhuber, E. *Light Metal and Heavy Metal Chill Casting* (German), 1966, pp. 178–181.

*Primary Examiner*—Nicholas P. Godici
*Assistant Examiner*—J. Reed Batten, Jr.
*Attorney, Agent, or Firm*—McGlew and Tuttle

[57] ABSTRACT

Improved small dendrite arm spacings and good technical values, regarding the technical properties of aluminum alloys, particularly tensile strength, yield strength and elongation percent, can be reliably obtained by refining the grain of the casting to provide the smallest possible spacings between the secondary dendrite arms, by casting the aluminum alloys in a ceramic mold provided with numerous micro-sized rough spots and pores and to the inner wall of which mold after it is dried and fired has been applied a thin layer of a salt mixture in which the cations are primarily from the alkalis and/or alkaline earths and the anions are primarily from halogens and which applied salt mixture has a liquidus temperature lower than the casting temperature of the alloy.

23 Claims, No Drawings

PROCESS FOR CASTING ALUMINUM ALLOYS

This is a continuation in part of copending parent application Ser. No. 847,428 filed Apr. 2, 1986 and now abandoned.

FIELD AND BACKGROUND OF THE INVENTION

This invention relates in general to aluminum alloys and in particular to a new and useful process for casting aluminum alloys.

The invention relates particularly to a process for casting aluminum alloys, i.e. hypoeutectic aluminum alloys, that contain more aluminum than corresponds to the eutectic with the other alloy constituents in order to achieve better strength values by reducing the secondary dendrite arm spacing upon solidification.

It is known that the technical properties of hypoeutectic aluminum alloys, particularly tensile strength, yield strength and elongation percent, can be improved by refining the grain of the casting. It is known that the strength properties of aluminum alloys are directly related to the number and fineness of the smallest possible dendrite arm intervals, the secondary dendrite arm spacing. According to *Foundary,* June 1963, pp. 78–82, the grain fineness of aluminum and aluminum-base alloys is improved by adding a pre-alloy to the aluminum alloy before casting that contains titanium diboride, for example, as heterogeneous seeds (nuclei).

From U.S. Pat. No. 3,259,948, it is known that the grain fineness of castings of cobalt- and nickel-base alloys can be improved by introducing seeds onto the inner surface of the casting mold. These seeds, e.g., cobalt aluminate and cobalt silicate, are applied pursuant to the U.S. patent, to the wax pattern and partly embedded in the inner surface of the mold by then dipping the wax pattern in a slurry of refractory mold material (dipping) and melting away the wax pattern. According to U.S. Pat. No. 3,019,497, seeds, again for the purpose of grain refinement, are mixed with the refractory material for dipping and applied to the wax pattern. According to U.S. Pat. No. 3,158,912, precious metals or reducible metallic oxides are added as seeds to the refractory material for dipping in the same manner as in the other patent mentioned. U.S. Pat. No. 3,157,926 works the same way and mentions nickel (III) oxide, cobalt (II) oxide and (III) oxide and nickel-cobalt hydroxide as the seeds. The seeds used in the above-mentioned U.S. patents are not effective in and are not proposed by the U.S. patents for reducing the secondary dendrite arm spacings and hence for improving the strength properties of hypo-eutectic aluminum alloys. For aluminum-base melts there are still no corresponding seeds that are suitable for embedding in the wall of the mold in order to produce a fine-grained casting. According to *Foundry,* 1963, the grain fineness of aluminum alloys is improved by adding seeds with the pre-alloy. This is unsatisfactory, however, in terms of reliability and obtaining the smallest possible secondary arm spacings.

German Pat. No. 963,642 teaches influencing the surface of the casting by means of additives to the mold material and alloys the surface with lead released by chemical reaction with the casting material. In order to avoid decarbonization of the skin, according to German Pat. No. 1,271,909, protective reducing materials that have melting points that lie between the casting temperature and the firing temperature of the casting mold are added to the mold material. German Pat. No. 1,265,356 discloses a method whereby the cavity of the mold is treated with a metallic hydride that releases hydrogen. The hydrogen is intended to reduce the oxide skin of the entering casting material, iron, for example, and thus increase flowability. It is known that the aluminum oxide of the cast skin of aluminum is not reducible by hydrogen. Furthermore, the presence of hydrogen during the casting of aluminum alloys is highly undesirable since it can cause the creation of gas bubbles.

The above mentioned German patents teach only that one can have an effect on the surface of the casting with the aid of substances introduced into the mold. The problem of achieving better grain refinement, particularly small secondary dendrite arm spacings in hypo-eutectic aluminum alloys is neither discussed nor solvable by the measure mentioned therein.

SUMMARY OF THE INVENTION

The invention provides a process to improve substantially grain fineness and in particular the reliability with which it can be adjusted. In accordance with the invention, the inner wall of the casting mold, i.e. a ceramic mold, is made with numerous micro-sized rough spots and the inner wall is provided with a thin layer of a salt mixture. The cations of the salt mixture consist largely of one or more alkali metals and/or one or more alkaline earth metals, and the anions consist largely of anions of the halogens, and the liquidus temperature of the salt mixture is set, or selected so as to be, lower than the casting temperature of the aluminum alloy.

Using this process, substantially higher values for strength and elongation were achieved than with the prior art processes. In the inventors' opinion, this is due to the fact that with the process pursuant to the invention, the metal melt, with the help of the salt mixture, which after the melt is poured should be as fluid as possible, fills in even the smallest pores and other rough spots on the inner wall of the mold shell. The metal cools there first and solidifies, so that many crystallization centers stand in a favorable crystalline orientation to the still liquid casting in the direction of heat elimination already predetermined by the geometry of the mold shell and can act as characteristic seeds. In addition, grain fineness in the interior is surely further improved by movement of broken-off dendrite arms through the melt into the central areas of the casting in addition to the advancing growth of the fine dendritic solidification front, or even areas of the inner wall of the mold that are relatively ineffective will be supplied with a sufficient number of characteristic seeds.

The fact that the ceramic mold with rough spots and pores is provided after drying and firing with the thin salt layer, which has a liquidus temperature lower than the casting temperature of the alloy, means that the salt mixture, being a thin, film-like layer that liquifies when the alloy is poured in, can spread out evenly even into the recesses of the rough spots and because of the thinness of the layer does not prevent the poured-in aluminum from penetrating into the pores. The salts, whose cations are largely from alkalis and/or alkaline earths and whose anions are primarily from halogens, reliably bring about a reduction in the dendrite arm spacing, according to the tests run by the inventors.

DESCRIPTION OF THE PREFERRED EMBODIMENTS

In great detail, this is how the invention may be advantageously put to use:

When casting aluminum, in order to achieve the smallest possible undercooling interval upon solidification, one requires crystallization centers with diameters on the order of from ten to several hundred angstrom units, which means that the geometry of the rough spots assume special significance. For this purpose, the invention recommends that as many as possible, but at any rate more than $10^5$ rough spots be created per $cm^2$ of the inner wall of the mold, with a depth to diameter or depth to fissure width ratio greater than 1 to 3. Recommended are rough spots in the form of pores, faults, fissures and cracks as well as preferably funnel-shaped recesses, formed as a result of micro-crystalline faults, that have their larger opening towards the casting.

Rough spots that are particularly advantageous from a geometrical standpoint can be obtained by applying a ceramic material, for example, that has a tendency to conchoidal fracturing, in the form of particularly fine-ground grains mostly less than 10 $\mu$m in diameter to the inner wall of the mold. This is done by "dipping" for example, i.e., dipping the wax pattern in a slurry of ceramic material in water or alcohol with a binder based on silicon dioxide base, for example. Other ceramic powders may also be used that already have an appropriate pore size and/or an appropriate grain fineness as a result of their method of production.

By including in the salt mixture one or more alkali and/or alkaline earth pseudo-halogen compounds or even organic salts of alkali metals and/or alkaline earth metals, better removal of oxygen residues, particularly in the pores of the mold, can be achieved. Appropriate alkali or alkaline earth pseudo-halogen compounds are cyanate, cyanide, thiocyanate, hexa- or tetracyano compounds, amines or amides or similar compounds chemically related to the alkali cyanates, cyanides and thiocyanides. The removal of the oxygen residues works not only for casting in air, but also for casting in a vacuum at about $10^{-2}$ torr. For this purpose it is advantageous to add these additional salts so that they constitute approximately 2–40% by weight of the total salt mixture. It is helpful if the salt admixture is limited in quantity so that it does not cause the gas released upon casting to create bubbles in the surface of the casting piece, if the released gas contains no molecular hydrogen, and further if the salt has no stable hydrates under the pressure and temperature conditions that occur in the pre-heating of the mold shell.

By applying the salt mixture in the form of a solution and/or finely dispersed slurry to the inner wall of the fired mold by pouring it in and out of the mold and subsequently drying it, one can provide the inner wall and its pore openings with different salts at the same time and with ultra-fine, uniform distribution, and furthermore apply to the inner wall extremely finely ground salts in slurry form that are insoluble or not readily soluble. At casting temperature, the intimate mixture of the various salts liquifies quickly. The preheating of the mold prior to casting to improve the flow of the casting material serves at the same time as a means of drying the applied salts. Water and/or alcohol are suitable solvents.

If one uses a salt mixture to coat the inner wall of the ceramic mold that consists primarily of sodium-lithium-chloride-fluoride with melting points below 650° C., the salt mixture can be liquified very quickly. These salt mixtures contain low melting mixtures of reciprocal pairs of salts with individual salts of low hydrostability, particularly in comparison with the potassium salts.

Particularly suitable is an aqueous and/or alcoholic solution of LiCl, NaF, NaCl and $Na_4Fe(CN)_6$. With this solution, no pre-melting and grinding of the salt mixture is required. Sodium fluoride is water-soluble. By an exchange of ions with the lithium chloride, fine-grained lithium fluoride precipitates out within a few hours.

By including a dispersing agent in the salt mixture solution and/or slurry, fine-grained, insoluble salts that precipitate out of the solution after a certain time like lithium fluoride can be held in suspension, thus facilitating uniform distribution of the salt mixture over the inner wall of the mold. A suitable dispersing agent is methyl cellulose, for example.

It also facilitates uniform distribution of the salt mixture upon drying to add to the salt mixture solution and/or slurry an auxiliary agent such as a surfactant that improves wetting of the inner wall of the ceramic mold.

In particular, the salt mixture has a liquidus temperature which is lower than the casting temperature of the hypoeutectic aluminum alloy, i.e. such aluminum alloys which contain more aluminum than the corresponding eutectics of aluminum and the substances alloyed therewith, e.g. hypoeutectic aluminum-silicon alloys which have a silicon content of less than 11%, as distinguished from eutectic aluminum-silicon alloys which have a silicon content of 11% and hypereutectic aluminum-silicon alloys which have a silicon content of more than 11%.

The salt mixture is also one in which the cations thereof comprise predominantly one or more alkali metals such as Li, Na, K, Rb and/or Cs, and/or one or more alkaline earth metals such as Be, Mg, Ca, Sr and/or Ba, and the anions thereof comprise predominantly one or more anions of the halogens such as F, Cl, Br and/or I, such that the salt mixture comprises, for example, at least two different individual salts having at least two different said cations where the salts have the same (common) anion or having at least two different said anions where the salts have the same (common) cation.

Thus, the salt mixture may comprise one (common) alkali metal cation and two or more different halogen anions, one (common) alkaline earth metal cation and two or more different halogen anions, two or more different alkali metal cations and one (common) halogen anion, two or more different alkaline earth metal cations and one (common) halogen anion, two or more mixed alkali metal and alkaline earth metal cations and one (common) halogen anion, and two or more mixed alkali metal and alkaline earth metal cations and two or more mixed halogen anions.

Typical mixed salt combinations include equal or differing molar proportions of sodium-lithium-chloride-fluoride; lithium-barium-chloride-fluoride; calcium-magnesium-sodium-potassium-chloride; calcium-magnesium-chloride; magnesium-chloride-fluoride; sodium-chloride-fluoride; and the like.

Such mixed salts may be applied to the inner wall of the ceramic mold in aqueous and/or alcoholic solutions and/or slurries, for drying in situ on the mold inner wall in the desired manner.

The invention will now be explained on the basis of various concrete examples:

Experiments showed that the secondary dendrite arm spacings were approximately 40–50 μm, while in the case of material treated according to the state of the art with a titanium diboride pre-alloy under the same casting conditions the intervals were approximately 80–90 μm.

EXAMPLE 1

20 wax clusters were produced, each composed of eight tensile test patterns 8 mm in diameter, with the tensile test patterns arranged in a circle around a downgate and each provided with a ring-shaped gate.

The wax clusters were covered with a first coat by dipping in a slurry consisting of an aqueous binder and fine-ground (<30 μm) zirconium silicate and silicon dioxide as fillers and sanded (stuccoed) with a coarse zirconium silicate powder. After drying, another six layers were applied by dipping, sanding and drying in conventional fashion, so that ceramic molds with walls about 8 mm thick were created. The molds were de-waxed under pressure in the autoclave and then fired at about 800° C.

An aqueous solution of 20 g of LiCl, 20 g of NaF, 5 g of $Na_4Fe(CN)_6$, 40 g of NaCl, 1 g of methyl cellulose and 0.1 g of surfactant per liter was then applied.

The solution was poured into the ceramic molds one after the other, immediately run off again, and filtered to remove any washed out ceramic grains.

The ceramic molds were then heated to approximately 470° C., placed in a vacuum casting unit while still hot and at approximately 250° C. mold temperature filled with the aluminum alloy GAlSi7Mg 0.6 at a melt temperature of 700° C. at $10^{-2}$ torr.

The aluminum melt was pre-melted in air, then degassed with a scavenging gas mixture and degassed again in a vacuum.

After conventional heat treatment, which included solution heat treatment and age hardening, the following strength values were obtained with little variation.

| | | |
|---|---|---|
| Tensile strength | $R_m$ | >340 N/mm$^2$ |
| Yield strength | $R_p$ 0.2 | >280 N/mm$^2$ |
| Elongation percent | $A_5$ | >6.5% |

EXAMPLE 2

Wax patterns of a structural aircraft part with an average wall thickness of 5 mm and a wall thickness at the junction points of 15 mm were assembled into wax clusters according to the method described in Example 1, coated with the ceramic lining, de-waxed under pressure in the autoclave and then fired at approximately 800° C.

An aqueous solution of 20 g of LiCl, 20 g of NaF, 5 g of $Na_4Fe(CN)_6$, 40 g of NaCl, 1 g of methyl cellulose and 0.1 g of surfactant per liter was then applied.

The solution was poured into the ceramic molds one after the other, immediately run off again, and filtered in order to remove any washed out ceramic grains.

The ceramic molds were then heated to approximately 470° C., placed in the vacuum casting unit while still hot, and at a mold temperature of approximately 250° C. filled with the aluminum alloy GAlSi7Mg 0.6 at a melt temperature of 700° C. at $10^{-2}$ torr.

The aluminum melt was melted in air, degassed with a scavenging gas mixture, and then degassed again in a vacuum.

Following the heat treatment, which included solution heat treatment and age hardening, the following strength values which little variation were found in flat test pieces from the precision casting portion:

| | | |
|---|---|---|
| Tensile strength | $R_m$ | 350 to 360 N/mm$^2$ |
| Yield strength | $R_p$ 0.2 | 290 to 310 N/mm$^2$ |
| Elongation percent | $A_5$ | 5 to 7% |

When the same melt was cast in a conventional mold without using the steps specified by the invention, the following values were obtained:

| | | |
|---|---|---|
| Tensile strength | $R_m$ | 300 N/mm$^2$ |
| Yield strength | $R_p$ 0.2 | 200 N/mm$^2$ |
| Elongation percent | $A_5$ | 3% |

The technical values for tensile strength, yield strength and elongation percent were thus substantially improved by the use of the invention.

EXAMPLE 3

Wax patterns were produced and assembled into wax clusters according to the method described in Example 1, coated with the ceramic, de-waxed under pressure in the autoclave and then fired at approximately 800° C.

An alcoholic solution/slurry consisting of 900 cc of isopropyl alcohol, to which was added 100 g of LiCl and $BaF_2$ in a corresponding weight ratio of the two salts of 77:23, was then applied.

The solution/slurry was poured into the ceramic molds one after the other, immediately run off again, and filtered to remove any washed out ceramic grains.

The ceramic molds were then heated to approximately 560° C., placed in a vacuum casting unit while still hot and at approximately 200° C. mold temperature filled with the aluminum alloy GAlSi7Mg 0.6 at a melt temperature of 690° C. at $10^{-2}$ torr.

The aluminum melt was pre-melted in air, then degassed with a scavenging gas mixture and degassed again in a vacuum.

After conventional heat treatment, which included solution heat treatment and age hardening, the following strength values were obtained with little variation.

| | | |
|---|---|---|
| Tensile strength | $R_m$ | 350 N/mm$^2$ |
| Yield strength | $R_p$ 0.2 | 281 N/mm$^2$ |
| Elongation percent | $A_5$ | 8.2% |

EXAMPLE 4

Wax patterns were produced and assembled into wax clusters according to the method described in Example 1, coated with the ceramic, de-waxed under pressure in the autoclave and then fired at approximately 800° C.

An aqueous solution consisting of 47–49 weight % $CaCl_2$, 6–7 weight % $MgCl_2$, 32–34 weight % NaCl, 11–12 weight % KCl, 1 g of methyl cellulose and 0.1 g of surfactant per liter was then applied.

The solution was poured into the ceramic molds one after the other, immediately run off again, and filtered to remove any washed out ceramic grains.

The ceramic molds were then heated to approximately 470° C., placed in a vacuum casting unit while still hot and at approximately 250° C. mold temperature filled with the aluminum alloy GAlSi7Mg 0.6 at a melt temperature of 700° C. at $10^{-2}$ torr.

The aluminum melt was pre-melted in air, then degassed with a scavenging gas mixture and degassed again in a vacuum.

After conventional heat treatment, which included solution heat treatment and age hardening, the following strength values were obtained with little variation.

| | | |
|---|---|---|
| Tensile strength | $R_m$ | >335 N/mm$^2$ |
| Yield strength | $R_p$ 0.2 | >280 N/mm$^2$ |
| Elongation percent | $A_5$ | >6% |

Similar results are obtained by way of the following experiments, in which the temperature of the aluminium-melt was fixed at 700° C.:

| Salt-mixtures in (mol %) of Salt II: | | Drying procedure of the inner wall coated mold | | | |
|---|---|---|---|---|---|
| | | vacuum dried | | air dried | |
| I | II | T/°C. | hrs | T/°C. | hrs |
| $CaCl_2$, $CaF_2$ (19%) | | 500 | 4 | | |
| $CaF_2$, $CaI_2$ (81%) | | 500 | 5 | | |
| KBr, KF (40%) | | 500 | 6 | | |
| KCl, KF (45%) | | 500 | 6 | | |
| KF, LiF (50%) | | 450 | 6 | | |
| LiCl, LiF (28%) | | 450 | 6 | | |
| LiF, NaF (39%) | | 450 | 5 | | |
| $MgF_2$, RbF (81%) | | | | 400 | 6 |
| NaBr, NaF (23%) | | 450 | 5 | | |
| NaCl, NaF (33.5%) | | | | 450 | 6 |
| NaF, NaI (82%) | | 400 | 4 | | |
| NaF, RbF (67%) | | | | 450 | 5 |
| $SrI_2$, $SrF_2$ (ca. 14%) | | 400 | 5 | | |
| $SrBr_2$, $SrF_2$ (ca. 14%) | | 400 | 5 | | |

What is claimed is:

1. Process for casting aluminum alloys which contain more aluminum than corresponds to the eutectic with the other alloy constituents, in a ceramic mold having an inner wall, for obtaining improved strength values by reducing the spacing of the intervals between the secondary dendrite arms which are formed in the casting upon solidification of the alloy melt in the inner wall of the ceramic mold, comprising providing the inner wall of the ceramic mold with numerous micro-sized rough spots, and providing the resultant rough spot containing inner wall with a thin layer of a salt mixture having a liquidus temperature which is lower than the casting temperature of the aluminum alloy, and in which the cations of the salt mixture comprise substantially one or more alkali metals and/or one or more alkaline earth metals, and the anions comprise substantially anions of halogens, for thereby forming in the ceramic mold an aluminum alloy casting which contains more aluminum than corresponds to the eutectic with the other alloy constituents and which has secondary dendrite arms of reduced spacing intervals therebetween for obtaining improved strength values in the aluminum alloy casting.

2. Process of claim 1 wherein the inner wall of the ceramic mold is provided with more than $10^5$ rough spots per cm$^2$ with a depth to diameter or depth to fissure width ratio greater than 1 to 3.

3. Process of claim 2 wherein the inner wall of the ceramic mold comprises refractory material made from extremely fine-grained oxide powder, obtained by grinding, and is produced by dipping a wax pattern in a slurry of the oxide powder, a filler and a binder, stuccoing with coarse ground ceramic powder and then drying and firing the dipped and stuccoed wax pattern whereby an oxide ceramic bond is created by the binder.

4. Process of claim 1 wherein the salt mixture further contains at least one of an alkali and/or alkaline earth pseudo-halogen compound in the form of a cyanate, cyanide, thiocyanate, hexa- and tetracyano compound, amine or amide, and similar compound chemically related to the alkali cyanates, cyanides, thiocyanates and/or organic salt and/or metallic organic compound of the alkali and alkaline earth metals.

5. Process of claim 1 wherein the salt mixture consists primarily of sodium-lithium-chloride-fluoride and has a melting point below 650° C.

6. Process of claim 5 wherein the thin layer of the salt mixture is provided on the inner wall of the ceramic mold by adding to said inner wall a liquid in the form of an aqueous and/or alcoholic solution of LiCl, NaF, NaCl and $Na_4Fe(CN)_6$.

7. Process of claim 1 wherein the thin layer of the salt mixture is provided on the inner wall of the ceramic mold by adding to said inner wall a liquid in the form of a solution and/or finely dispersed slurry of the salt mixture by pouring the liquid into and out of the ceramic mold, and then drying the resulting salt mixture so applied to the mold.

8. Process of claim 7 wherein the liquid contains a dispersing agent.

9. Process of claim 7 wherein the liquid contains an auxiliary wetting agent for improved wetting of the inner wall of the ceramic mold.

10. Process for casting hypoeutectic aluminum alloys which contain more aluminum than the corresponding eutectics of aluminum and the substances alloyed therewith, in a ceramic mold having an inner wall, for obtaining improved strength values by reducing the spacing of the intervals between the secondary dendrite arms which are formed in the casting upon solidification of the alloy melt in the inner wall of the ceramic mold, comprising providing the ceramic mold with an inner wall having numerous micro-sized rough spots, providing the resultant rough spot containing inner wall with a thin layer in situ of a salt mixture having a liquidus temperature which is lower than the casting temperature of the aluminum alloy, and in which the cations of the salt mixture comprise predominantly one or more alkali metals and/or one or more alkaline earth metals, and the anions comprise predominantly anions of halogens, such that the salt mixture comprises at least two different individual salts having at least two different said cations where the salts have the same anion or having at least two different said anions where the salts have the same cation, and forming in the inner wall of the ceramic mold a hypoeutectic aluminum alloy casting which contains more aluminum than the corresponding eutectic of the aluminum and the substances alloyed therewith and which has secondary dendrite arms of reduced spacing intervals therebetween for obtaining improved strength values in the aluminum alloy casting.

11. Process of claim 10 wherein the inner wall of the ceramic mold is provided with more than $10^5$ rough spots per cm$^2$ with a depth to diameter or depth to fissure width ratio greater than 1 to 3.

12. Process of claim 11 wherein the inner wall of the ceramic mold comprises refractory material made from extremely fine-grained oxide powder, obtained by grinding, and is produced by dipping a wax pattern in a slurry of the oxide powder, a filler and a binder, stuccoing with coarse ground ceramic powder and then drying and firing the dipped and stuccoed wax pattern whereby an oxide ceramic bond is created by the binder.

13. Process of claim 10 wherein the thin layer of the salt mixture is provided on the inner wall of the ceramic mold by adding to said inner wall a liquid in the form of a solution and/or finely dispersed slurry of the salt mixture by pouring the liquid into and out of the ceramic mold, and then drying the resulting salt mixture so applied to the mold.

14. Process of claim 13 wherein the thin layer of the salt mixture is provided on the inner wall of the ceramic mold by adding to said inner wall a liquid in the form of an aqueous and/or alcoholic solution of LiCl, NaF, NaCl and $Na_4Fe(CN)_6$.

15. Process of claim 13 wherein the liquid contains a dispersing agent.

16. Process of claim 13 wherein the liquid contains an auxiliary wetting agent for improved wetting of the inner wall of the ceramic mold.

17. Process of claim 10 wherein the salt mixture further contains at least one of an alkali and/or alkaline earth pseudo-halogen compound in the form of a cyanate, cyanide, thiocyanate, hexa- and tetracyano compound, amine or amide, and similar compound chemically related to the alkali cyanates, cyanides, thiocyanates and/or organic salt and/or metallic organic compound of the alkali and alkaline earth metals.

18. Process of claim 10 wherein the salt mixture consists primarily of sodium-lithium-chloride-fluoride and has a melting point below 650° C.

19. Process of claim 10 wherein the salt mixture consists primarily of lithium-barium-chloride-fluoride.

20. Process of claim 10 wherein the salt mixture consists primarily of calcium-magnesium-sodium-potassium-chloride.

21. Process of claim 10 wherein the salt mixture consists primarily of calcium-magnesium-chloride.

22. Process of claim 10 wherein the salt mixture consists primarily of magnesium-chloride-fluoride.

23. Process of claim 10 wherein the salt mixture consists primarily of sodium-chloride-fluoride.

* * * * *